US012251000B1

(12) United States Patent
Richardson

(10) Patent No.: US 12,251,000 B1
(45) Date of Patent: Mar. 18, 2025

(54) MAGNETIC NECKTIE RETAINER

(71) Applicant: Colby Richardson, Bountiful, UT (US)

(72) Inventor: Colby Richardson, Bountiful, UT (US)

(73) Assignee: Colby Richardson, Bountiful, UT (US)

( * ) Notice: Subject to any disclaimer, the term of this patent is extended or adjusted under 35 U.S.C. 154(b) by 0 days.

(21) Appl. No.: 18/453,276

(22) Filed: Aug. 21, 2023

(51) Int. Cl.
*A44B 6/00* (2006.01)

(52) U.S. Cl.
CPC ..... *A44B 6/00* (2013.01); *A44D 2203/00* (2013.01)

(58) Field of Classification Search
CPC ... A44B 6/00; A44D 2203/00; Y10T 24/1959; Y10T 24/1924
See application file for complete search history.

(56) References Cited

U.S. PATENT DOCUMENTS 3,474,503 A * 10/1969 Less ..... A44B 6/00 24/56
5,337,457 A * 8/1994 Chennault ..... A44B 6/00 24/66.4
6,857,167 B2 * 2/2005 Bishop ..... A45F 5/02 24/113 MP
7,373,696 B2 5/2008 Schoening et al.
8,713,762 B2 5/2014 Bates et al.
8,938,813 B2 1/2015 McDowell
2010/0115734 A1 5/2010 Wilson

OTHER PUBLICATIONS

Clipoff Tie Stay, https://clipofftiestay.com/, retrieved Nov. 17, 2023, 7 pages.
Tie Mags Magnetic Tie Clips, https://tiemags.com, retrieved Nov. 17, 2023, 7 pages.

* cited by examiner

*Primary Examiner* — Robert Sandy
(74) *Attorney, Agent, or Firm* — Weaver Austin Villeneuve & Sampson LLP

(57) ABSTRACT

In some implementations, a necktie retainer apparatus may include magnetically couplable first and second pieces. The first piece may include a slot with an opening that allows the first piece to be positioned over a button such that the button threads extend through the slot. The second piece may be positioned through a tie loop of a necktie, such that when the second piece is magnetically coupled with the first piece, the necktie is restrained to the article of clothing to which the button is fastened via the tie loop. In some embodiments, magnets may be placed at one or both ends of either or both the first and second pieces, allowing room for the button and tie loop to fit between the pieces after being magnetically coupled.

20 Claims, 6 Drawing Sheets

MAGNETIC NECKTIE RETAINER

BACKGROUND

Neckties are an article of clothing commonly worn at work, formal events, and/or other occasions. Because they hang from the wearer's neck and are typically not otherwise fastened to the wearer's body, they are often subject to being displaced by wind, movement by the wearer, and other events. Traditional necktie retainers, or necktie restraints, typically involve a pin that punctures through the tie or a spring-loaded clip which may then be tethered to the wearer's shirt. However, this may be damaging to a tie. And although some alternatives may involve magnets that avoid such damage, such alternatives often have limited effectiveness and may be limited to where they may be placed.

BRIEF SUMMARY

Embodiments described herein address these and other issues by providing a necktie retainer that comprises magnetically couplable first and second pieces. The first piece may include a slot with an opening that allows the first piece to be positioned over a button such that the button threads extend through the slot. The second piece may be positioned through a tie loop of a necktie, such that when the second piece is magnetically coupled with the first piece, the necktie is restrained to the article of clothing to which the button is fastened via the tie loop. In some embodiments, magnets may be placed at one or both ends of either or both the first and second pieces, allowing room for the button and tie loop to fit between the pieces after being magnetically coupled. Embodiments provided herein can allow for positioning of the necktie retainer in a variety of locations, allowing for the use of the necktie retainer without concern about where a tie loop of the necktie is in relation to one or more buttons of a shirt.

This summary is neither intended to identify key or essential features of the claimed subject matter, nor is it intended to be used in isolation to determine the scope of the claimed subject matter. The subject matter should be understood by reference to appropriate portions of the entire specification of this disclosure, any or all drawings, and each claim. The foregoing, together with other features and examples, will be described in more detail below in the following specification, claims, and accompanying drawings.

Like reference symbols in the various drawings indicate like elements, in accordance with certain example implementations. In addition, multiple instances of an element may be indicated by following a first number for the element with a letter or a hyphen and a second number. For example, multiple instances of an element 110 may be indicated as 110-1, 110-2, 110-3, etc., or as 110*a*, 110*b*, 110*c*, etc. When referring to such an element using only the first number, any instance of the element is to be understood (e.g., element 110 in the previous example would refer to elements 110-1, 110-2, and 110-3 or to elements 110*a*, 110*b*, and 110*c*).

DETAILED DESCRIPTION

Several illustrative examples will now be described with respect to the accompanying drawings, which form a part hereof. While particular examples, in which one or more aspects of the disclosure may be implemented, are described below, other examples may be used, and various modifications may be made without departing from the scope of the disclosure or the appended claims. Further, specific values and/or ranges are provided herein as nonlimiting examples for certain aspects (e.g., dimensions) of the embodiments described herein. A person of ordinary skill in the art will appreciate, however, that embodiments may not be limited to such values and/or ranges.

As previously noted, traditional necktie retainers typically involve a pin that punctures through the tie, a spring-loaded clip that holds onto the tie, or may have a magnetic design that may restrict the placement of the retainer. Moreover, most traditional tie retainers have a piece that is placed in front of the tie, making the tie retainer visible, which may not be desired. Embodiments described herein address these and other issues by providing a versatile necktie retainer that comprises magnetically couplable first and second pieces that may provide a hidden design when worn and further allow for various shirt button and tie loop configurations.

Figure 1A:
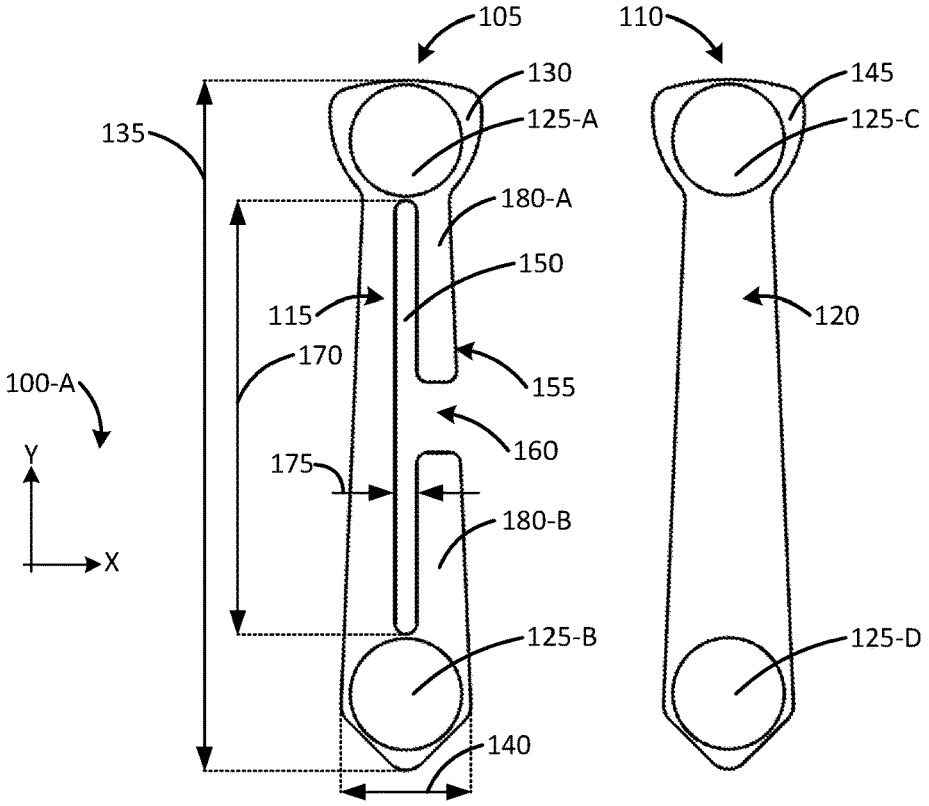
FIGS. 1A-1C are illustrations of different views of a necktie retainer, according to an embodiment.
Figure 1B:
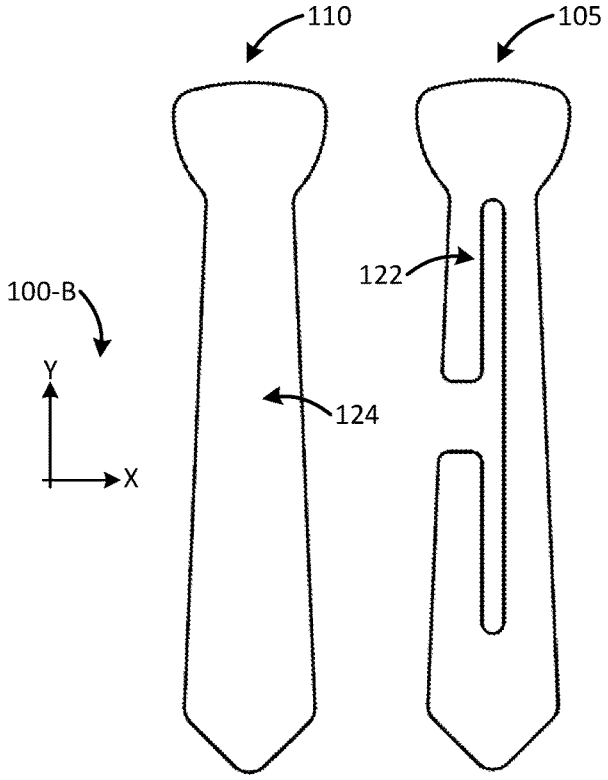
Figure 1C:
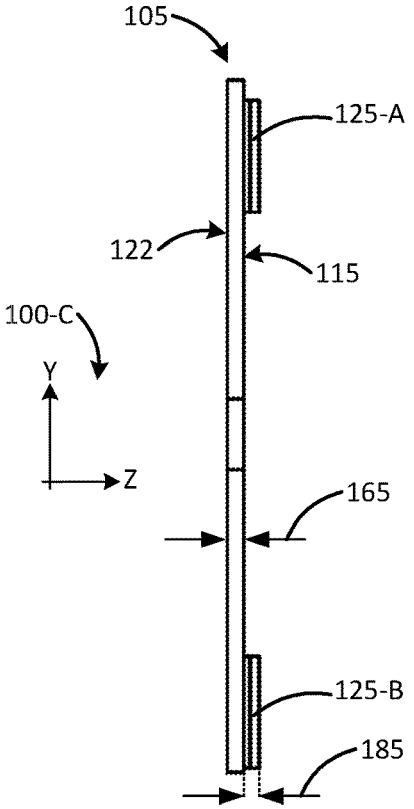

FIGS. 1A-1C are illustrations of different views of a necktie retainer, according to an embodiment. (Each illustration has a respective coordinate frame 100-A, 100-B. 100-C, for reference.) The necktie retainer comprises first piece 105 and second piece 110, which are magnetically couplable, as described in further detail below, to retain a necktie to an article of clothing. FIG. 1A comprises a front view of each of a first piece 105 and a second piece 110, FIG. 1B comprises a rearview of each of first piece 105 and second piece 110. FIG. 1C comprises a side view of first piece 105 (second piece 110 is not shown in FIG. 1C). As described in further detail below, first piece 105 may be worn between an inner portion of an article of clothing to which one or more buttons are sewn and an outer portion of the article of clothing in which one or more buttonholes are located. Second piece 110 may be placed through a tie loop of the necktie such that, when first piece 105 and second piece 110 are magnetically coupled, the necktie is restrained to the article clothing.

It can be noted that FIGS. 1A-1C are provided as nonlimiting examples only. Different embodiments may vary in dimensions, shapes, and/or other aspects of the necktie retainer, including first piece 105, second piece 110, and/or components (described below) thereof, depending on desired functionality, manufacturing constraints, and/or other factors. For instance, first piece 105 and second piece 110 of the example embodiment illustrated in FIGS. 1A-1C are in the shape of a necktie, but embodiments are not so limited.

FIG. 1A is an illustration of inner surfaces 115 and 120 of first piece 105 and second piece 110, respectively. (FIG. 1B shows respective outer surfaces 122 and 124 of first piece 105 and second piece 110.) As described in more detail hereafter, when first piece 105 and second piece 110 are magnetically coupled with each other, inner surfaces 115 and 120 face each other. However, magnets may protrude from the surfaces to prevent the services from touching, leaving room for a button to fit between inner surfaces 115 and 120.

The example necktie retainer illustrated in FIGS. 1A-1C has four magnets: magnets 125-A, 125-B, 125-C, and 125-D (collectively and generically referred to herein as magnets 125). (That said, alternative embodiments may have a different number of magnets.) In this example, magnet 125-A couples with 125-C, and magnet 125-D couples with magnet 125-D. This four-magnet design therefore helps ensure alignment of first piece 105 and the second piece 110 when magnetically coupled. That said, alternative embodiments may utilize fewer magnets. A two-magnet design, for example, may feature a pair of magnets on either first piece 105 (e.g., magnets 125-A and 125-B) or second piece 110 (e.g., magnets 125-C and 125-D). In such a design, the piece not having magnets may comprise a magnetic material (e.g., either the entire body of the piece or one or more portions of the piece intended to be attracted to the magnets of the opposite piece).

As further illustrated, first piece 105 may have various features to enable the positioning of the necktie retainer on a button of an article of clothing (e.g., a shirt) and, as described in more detail hereafter, adjustment to accommodate the location of the button relative to a tie loop. In reference to coordinate frames 100, the first piece 105 may comprise body 130 that has height 135 in a first dimension (e.g., Y dimension) that is elongated relative to a width 140 of body 130 in a second dimension (e.g., X dimension). According to various embodiments, body 145 of second piece 110 may be similarly shaped and have similar dimensions as first piece 105. The first piece 105 may further comprise slot 150 that passes through the body of first piece 105 in a third dimension (e.g., Z dimension). The slot also may have a height in the first dimension that is elongated relative to the width of the slot in a second dimension. Further, to enable positioning of first piece 105 on a button, first piece 105 may include a gap in an edge 155 of body 130, creating an opening 160 in body 130 that extends from the edge 155 of first piece 105 along the second dimension (e.g., X dimension) to a portion of slot 150.

The size of first piece 105 and second piece 110 may vary. Generally, height 135 may be selected to fit between buttons of an article clothing. The distance between buttons of common button-up shirts, for example, generally may be larger than a certain threshold. And thus, height 135 may be less than this threshold. According to some embodiments, for example, height 135 is between 2.5 and 3.1 inches.

With respect to width 140, this may be chosen to help ensure that the necktie retainer is hidden when in use. As explained in further detail hereafter, first piece 105 may be located behind a button when in use and may be hidden by a portion of the article of clothing in which the buttonhole for the button is located. And thus, width 140 may be chosen based on the common widths of the portion of the article of clothing in which the buttonhole is located. According to some embodiments, for example, width 140 is between 0.25 and 0.8 inches.

With respect to thickness 165, this may be chosen to allow body 130 of first piece 105 to fit behind the button of an article of clothing. Thus, thickness 165 may be chosen based on common lengths of threads used to fasten buttons to articles of clothing. According to some embodiments, for example, it is 165 is between 0.03 and 0.15 inches.

The above-referenced dimensions of the first piece 105, and corresponding dimensions for second piece 110, also may be impacted by material strength. According to various embodiments, body 130 and body 145 of first piece 105 and second piece 110, respectively, may comprise any of a variety of suitable materials. This can include, for example, a variety of types of plastics, metals, woods, etc. Magnetic metals may be used, for example, to reduce the number of magnets for magnetically coupling first piece 105 and second piece 110, however, they may be more expensive than alternative materials. Plastics may allow for some flexibility, which may be helpful in certain scenarios. Based on the material(s) used, dimensions may be selected to help ensure the structural integrity of first piece 105 and second piece 110.

Material strength also may be a consideration when determining slot height 170, slot width 175, and location of opening 160. Slot height 170 may be selected to allow the first piece 105 to slide vertically up and down (e.g., along the Y dimension) after it is positioned on a button, enabling a user to select a suitable vertical position for the necktie retainer. For example, if the tie loop through which the second piece 110 is inserted is located above the button on which the first piece 105 is positioned, the user may slide the first piece 105 upward, thereby enabling the first piece 105 and second piece 110 to be magnetically coupled while remaining positioned on the button and through the tie loop, respectively. Slot width 175 may be wide enough to enable button threads to pass through slot 150, but not too wide to allow a loose fit (e.g., excessive lateral movement in the X dimension) or to allow the button to fit through slot 150.

The positioning of the opening 160 relative to slot 150 may vary. As illustrated in FIGS. 1A-1C, the opening 160 may be substantially at a midpoint of the slot's height (e.g., in the Y dimension). Alternative embodiments may have an opening 160 above or below this midpoint. However, the structural integrity of an upper arm 180-A and lower arm 180-B may need to be considered. For example, if the opening 160 is located toward the bottom of slot 150, this will increase the length of upper arm 180-A, which may then be more susceptible to bending and/or breaking.

As illustrated in FIG. 1C, because magnets 125-A and 125-B protrude above surface 115, the thickness 185 of these magnets can impact how close inner surfaces 115 and 120 are when first piece 105 and second piece 110 are magnetically coupled. Because the button on which the first piece 105 is positioned fits between the first piece 105 and second piece 110 when magnetically coupled (as described in more detail hereafter), thickness 185 may be chosen to accommodate common button thicknesses. Alternative embodiments may include other protrusions (e.g., structures and casing magnets) that define the distance between first piece 105 and second piece 110 when magnetically coupled. And thus, the thickness of these other protrusions may be taken into account in a similar manner.

FIGS. 2-4B are provided to help illustrate how a magnetic necktie retainer of the manner described herein may be used, according to some embodiments.

Figure 2:
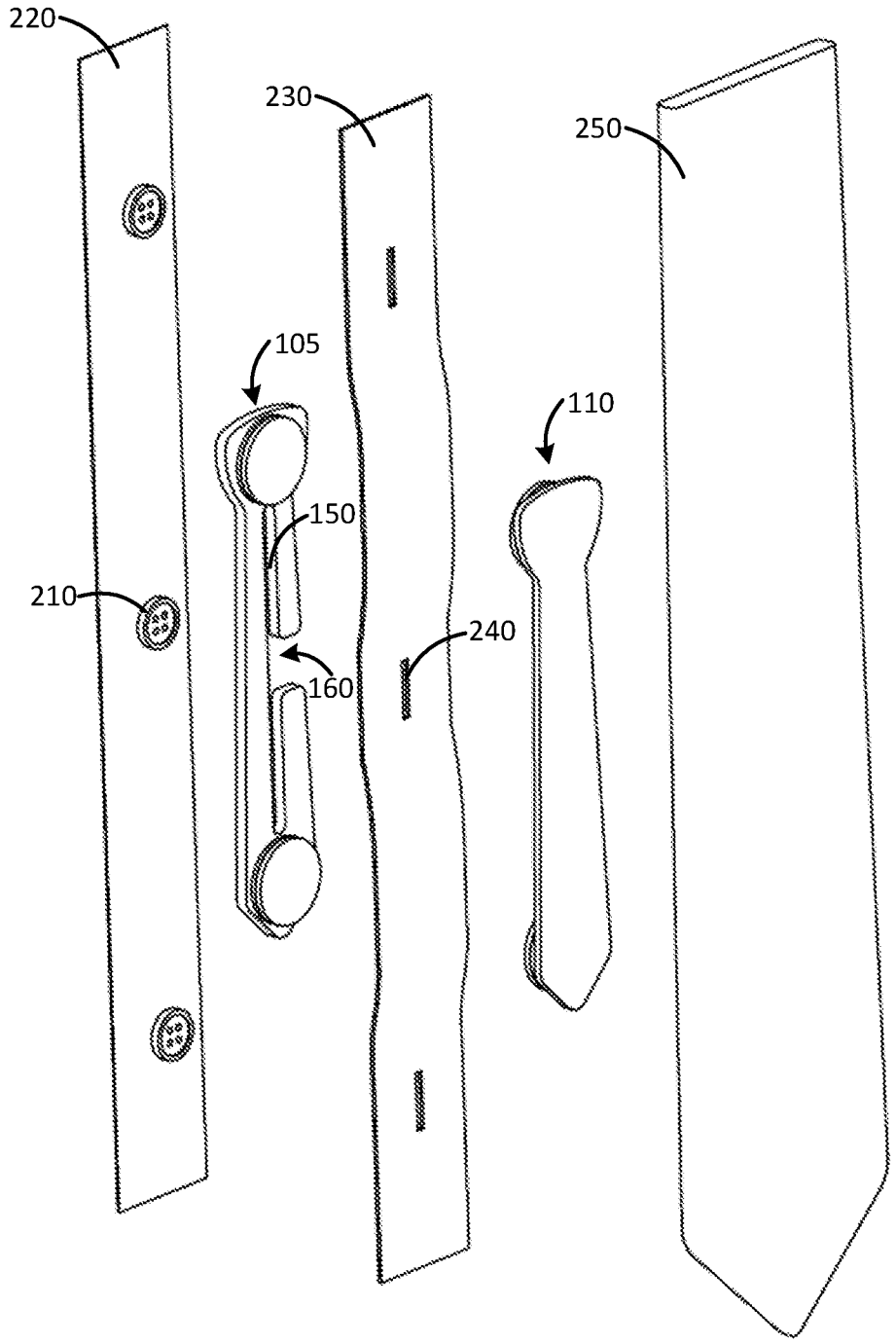
FIG. 2 is an exploded view illustrating how the magnetic necktie retainer may be used, according to an embodiment.

FIG. 2 is an exploded view illustrating how the magnetic necktie retainer may be used, according to an embodiment. For clarity, only relevant portions of the article of clothing and necktie are shown. As illustrated, first piece 105 is positioned on button 210 affixed to a first portion 220 of an article of clothing via a thread. As previously described with respect to FIGS. 1A-1C, the first piece 105 is positioned by sliding the opening 160 over the button 210 such that the thread fits in slot 150. The button 210 therefore restrains the first piece 105 to first portion 220 of the article clothing. The first piece 105 fits behind a second portion 230 of the article clothing in which the buttonhole 240 of button 210 is located. Second piece 110 is through a tie loop (not shown) of the necktie 250 such that the necktie is restrained when second piece 110 and first piece 105 are magnetically coupled. Slot 150 allows for the vertical repositioning of the necktie retainer, to accommodate differences in the locations of button 210 and tie loop.

Figure 3:
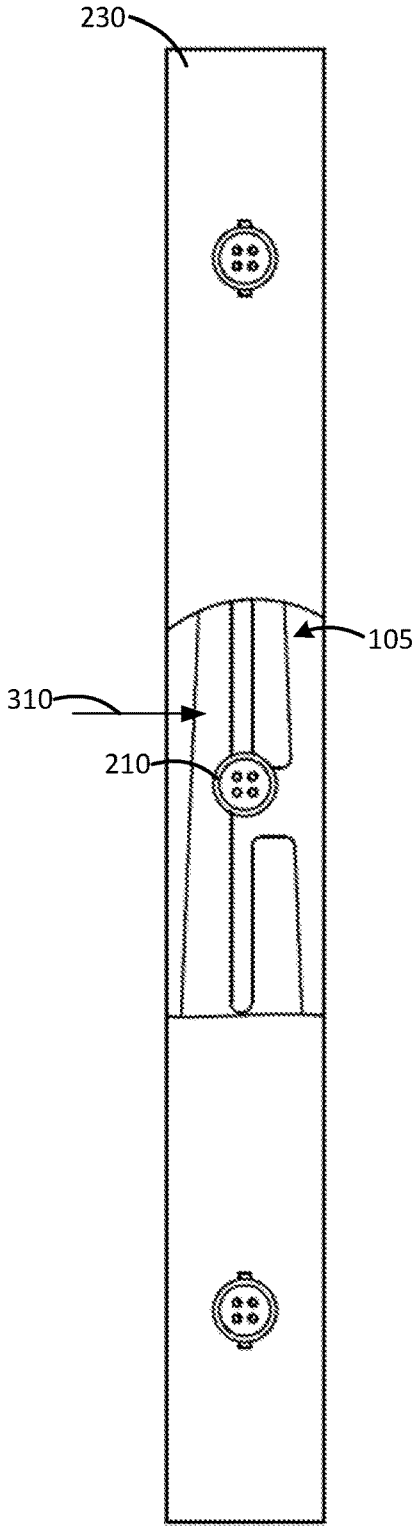
FIG. 3 is a slot view illustrating how the magnetic necktie retainer may be used, according to an embodiment.

Again, first piece 105 may be positioned on button 210 when the article of clothing is in use, and button 210 is already inserted into buttonhole 240. An example of this is illustrated in FIG. 3, in which arrow 310 shows the direction in which first piece 105 may be moved to position first piece 105 over button 210.

Figure 4A:
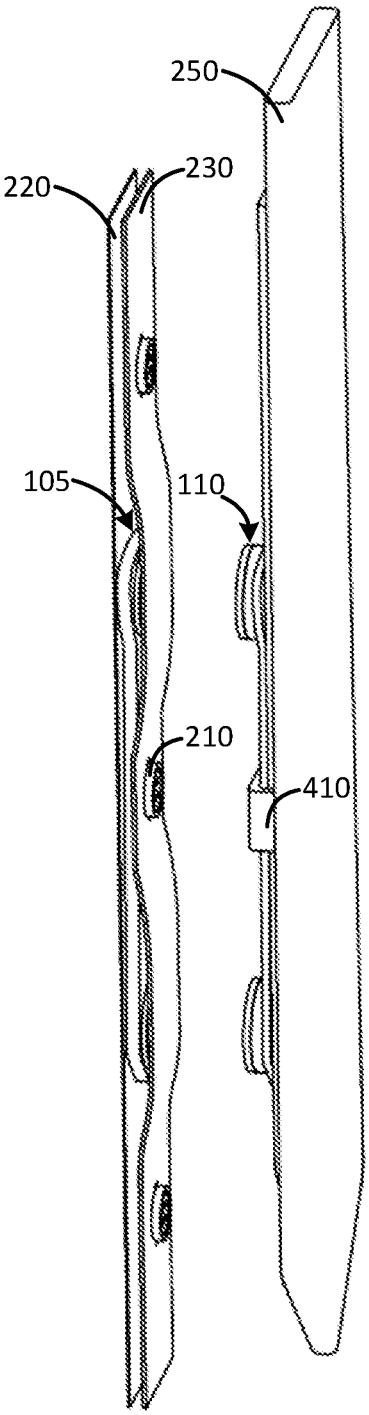
FIGS. 4A and 4B are side views illustrating how the magnetic necktie retainer may be used, according to an embodiment.

FIG. 4A is a side view illustrating both of the first piece 105 and second piece 110 in use, while the pieces are uncoupled. Here, the tie loop 410 is shown. Tie loops are typically found on most neckties near a front portion of the necktie and may comprise a fabric material and/or label through which a back portion of the necktie is often inserted. As illustrated, the second piece 110 is inserted through tie loop 410 when in use.

Figure 4B:
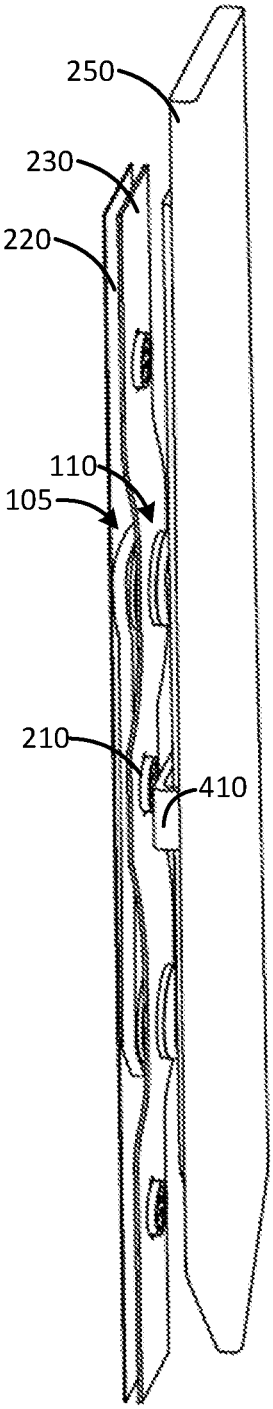

FIG. 4B is a side view similar to FIG. 4A, illustrating the same components shown in FIG. 4A after first piece 105 and second piece 110 are magnetically coupled. As can be seen, second portion 230 of the article clothing fits between first piece 105 and second piece 110 when magnetically coupled. Thus, the magnets used to enable the magnetic coupling may account for this. According to some embodiments, the pull strength of the magnets may be 2 to 4 pounds of pull force. Additionally, or alternatively, magnets may be ceramic, alnico, samarium cobalt, or neodymium.

Figure 5:
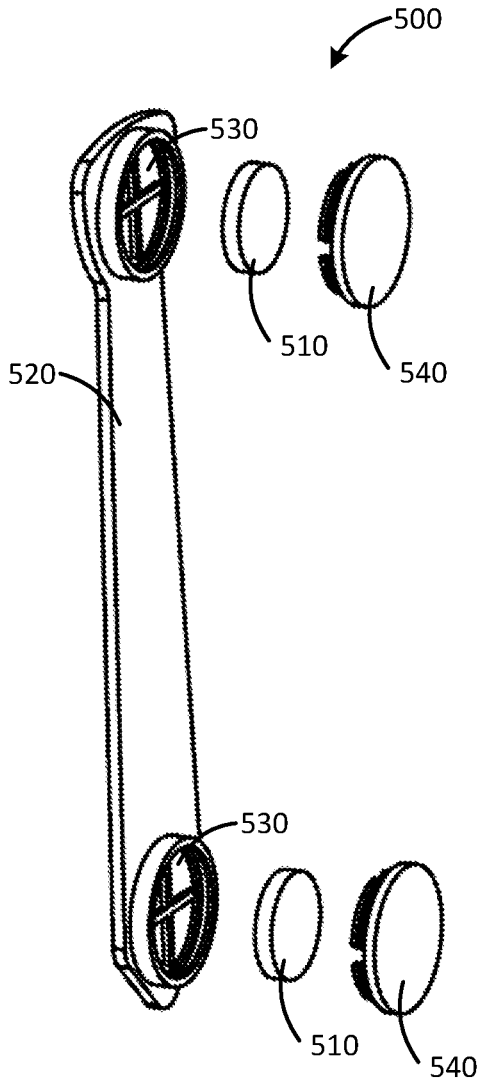
FIG. 5 is an exploded view illustrating a way in which magnets may be coupled with a body of a necktie piece, according to an embodiment.

FIG. 5 is an exploded view 500 illustrating a way in which magnets 510 (e.g., magnets 125) may be coupled with a body 520 of a necktie piece (e.g., first piece 105 and/or second piece 110), according to an embodiment. In this embodiment, magnets 510 are encased in a housing 530 with snap-fit covers 540. As such, in such embodiments, the strength and/or type of the magnets 510 may be selected to account for the thickness and/or material(s) of the snap-fit covers 540, to help ensure magnetic coupling occurs as described herein. Alternative embodiments may use additional or alternative means for coupling magnets 510 with body 520. This can include bonding magnets 510 directly with body 520 (e.g., via an adhesive or physical bonding) and/or encasing magnets 510 in a type of housing different than the one shown in FIG. 5.

Figure 6:
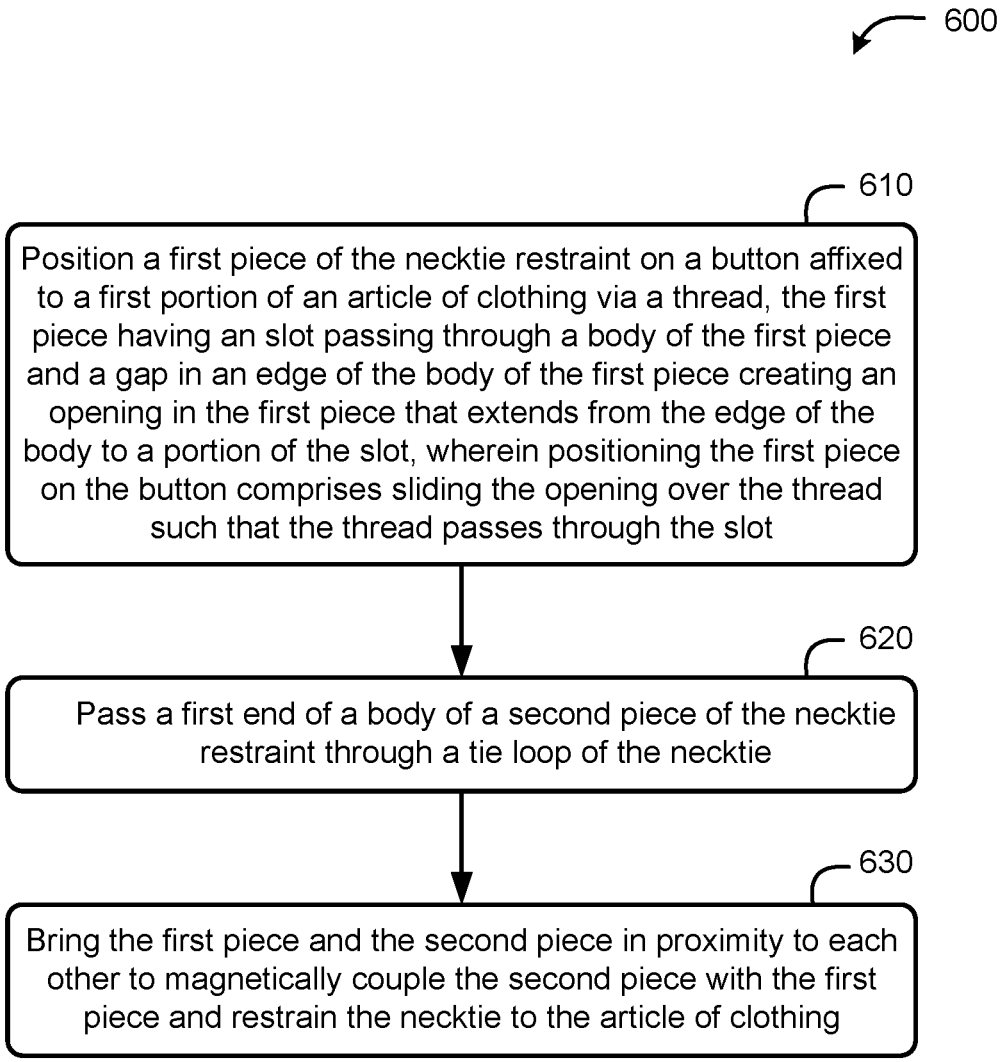
FIG. 6 is a flow diagram illustrating a method of using a necktie retainer, according to an embodiment.

FIG. 6 is a flow diagram 600 illustrating a method of using a necktie retainer, according to an embodiment. The necktie retainer may include a first piece and second piece (e.g., first piece 105 and second piece 110) in the manner detailed in the above-described embodiments.

The functionality at block 610 comprises positioning a first piece of the necktie retainer on a button affixed to a first portion of an article of clothing via a thread, the first piece having a slot passing through a body of the first piece and a gap in an edge of the body of the first piece creating an opening in the first piece that extends from the edge of the body to a portion of the slot, wherein positioning the first piece on the button comprises sliding the opening over the thread such that the thread passes through the slot. As noted herein, a necktie retainer as described herein may be positioned after an article of clothing is in use (e.g., a button is inserted through a buttonhole). Thus, according to some embodiments, the positioning the first piece of the necktie retainer on the button occurs after the button is passed through a buttonhole of a second portion of the article of clothing. In some instances, the article of clothing a comprise a shirt.

The functionality at block 620 comprises passing a first end of a body of a second piece of the necktie retainer through a tie loop of the necktie. An example of the use of a tie loop in this manner is illustrated in FIGS. 4A and 4B.

The functionality at block 630 comprises bringing the first piece and the second piece in proximity to each other to magnetically couple the second piece with the first piece and retain the necktie to the article of clothing. As noted, magnetic coupling may be based on the use of one or more magnets, which may have various configurations, as described herein. According to some embodiments, the second piece may be magnetically coupled with the first piece at least in part via: a first magnet coupled with the body of the first piece between a first end of the slot and a first end of the body of the first piece, and a second magnet coupled with the body of the first piece between a second end of the slot and a second end of the body of the first piece. An example of this is shown in FIGS. 1A-1C. Moreover, as described herein, both pieces may include magnets. Thus, according to some embodiments, the second piece may be magnetically coupled with the first piece further via one or more magnets coupled with a first surface of the body of the second piece. As illustrated in FIG. 4B, for example, a button may fit between first and second pieces when magnetically coupled. As such, according to some embodiments of the method shown in FIG. 6, after the second piece is magnetically coupled with the first piece, the button is located between a surface of the body of the first piece and a surface of the body of second piece with which the surface of the body of the first piece is coupled. According to some embodiments, a distance between the surface of the body of the first piece and the surface of the body of second piece is between 0.08 and 0.15 inches. As described herein with respect to FIG. 1C, this distance may be determined by the thickness 185 of magnets (or housing for magnets) located on one or both pieces.

As also discussed herein, one or more of the dimensions of the first and second pieces may vary, depending on desired functionality. According to some embodiments, the elongated slot is elongated along a first dimension relative to a width of the slot in a second dimension, and a height of the body of the first piece in the first dimension, a height of the body of the second piece in the first dimension, or both, is between 2.5 and 3.2 inches. According to some embodiments, the elongated slot is elongated along a first dimension relative to a width of the slot in a second dimension, and wherein a width of the body of the first piece in the second dimension, a width of the body of the second piece in the second dimension, or both, is between 0.25 and 0.8 inches. According to some embodiments, the elongated slot is elongated along a first dimension relative to a width of the slot in a second dimension, and wherein, for a third dimension mutually orthogonal to the first dimension and the second dimension, a thickness of the body of the first piece in the third dimension, a thickness of the body of the second piece in the third dimension, or both, is between 0.03 and 0.15 inches.

The methods, systems, and devices discussed herein are examples. Various embodiments may omit, substitute, or add various procedures or components as appropriate. For instance, features described with respect to certain embodiments may be combined in various other embodiments. Different aspects and elements of the embodiments may be combined in a similar manner. The various components of the figures provided herein can be embodied in hardware and/or software. Also, technology evolves and, thus many of the elements are examples that do not limit the scope of the disclosure to those specific examples.

Terms, "and" and "or" as used herein, may include a variety of meanings that also is expected to depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein may be used to describe any feature, structure, or characteristic in the singular or may be used to describe some combination of features, structures, or characteristics. However, it should be noted that this is merely an illustrative example and claimed subject matter is not limited to this example. Furthermore, the term "at least one of" if used to associate a list, such as A, B, or C, can be interpreted to mean any combination of A, B, and/or C, such as A, AB, AA, AAB, AABBCCC, etc.

Having described several embodiments, various modifications, alternative constructions, and equivalents may be used without departing from the scope of the disclosure. For example, the above elements may merely be a component of a larger system, wherein other rules may take precedence over or otherwise modify the application of the various embodiments. Also, a number of steps may be undertaken before, during, or after the above elements are considered. Accordingly, the above description does not limit the scope of the disclosure.

What is claimed is:

1. A necktie retainer apparatus comprising:

a first piece having a body with a height in a first dimension that is elongated relative to a width of the body of the first piece in a second dimension, wherein the first piece further comprises:

a slot passing through the body of the first piece in a third dimension from a first surface of the body of the first piece to a second surface of the body of the first piece, the slot having a height in the first dimension that is elongated relative to a width of the slot in the second dimension; and a gap in an edge of the body of the first piece creating an opening in the first piece that extends from the edge of the body of the first piece along the second dimension to a portion of the slot; and a second piece having a body with a height in the first dimension that is elongated relative to a width of the body of the second piece in the second dimension, wherein the second piece is magnetically couplable with the first piece.

2. The necktie retainer apparatus of claim 1, wherein the second piece is magnetically couplable with the first piece at least in part via:

a first magnet coupled with the first surface of the body of the first piece between a first end of the slot and a first end of the body of the first piece; and a second magnet coupled with the first surface of the body of the first piece between a second end of the slot and a second end of the body of the first piece.

3. The necktie retainer apparatus of claim 2, wherein the second piece is magnetically couplable with the first piece further via one or more magnets coupled with a first surface of the body of the second piece.

4. The necktie retainer apparatus of claim 1, wherein the height of the body of the first piece, the height of the body of the second piece, or both, is between 2.5 and 3.1 inches.

5. The necktie retainer apparatus of claim 1, wherein the width of the body of the first piece, the width of the body of the second piece, or both, is between 0.25 and 0.8 inches.

6. The necktie retainer apparatus of claim 1, wherein a thickness of the body of the first piece in the third dimension, a thickness of the body of the second piece in the third dimension, or both, is between 0.03 and 0.15 inches.

7. The necktie retainer apparatus of claim 1, wherein the necktie retainer apparatus is configured such that, when the second piece is magnetically coupled with the first piece, there is sufficient distance between the first surface of the body of the first piece and a surface of the body of second piece with which the first piece is coupled to fit a shirt button.

8. The necktie retainer apparatus of claim 7, wherein the distance between the first surface of the body of the first piece and the surface of the body of the second piece is between 0.08 and 0.15 inches.

9. The necktie retainer apparatus of claim 1, wherein the gap is located at substantially the middle of the body of the body of the first piece along the first dimension.

10. The necktie retainer apparatus of claim 1, wherein the gap is located at an end of the slot in the first dimension.

11. A method of using a necktie retainer apparatus comprising:

positioning a first piece of the necktie retainer on a button affixed to a first portion of an article of clothing via a thread, the first piece having a slot passing through a body of the first piece and a gap in an edge of the body of the first piece creating an opening in the first piece that extends from the edge of the body to a portion of the slot, wherein positioning the first piece on the button comprises sliding the opening over the thread such that the thread passes through the slot;

passing a first end of a body of a second piece of the necktie retainer through a tie loop of the necktie; and bringing the first piece and the second piece in proximity to each other to magnetically couple the second piece with the first piece and retain the necktie to the article of clothing.

12. The method of claim 11, wherein the positioning the first piece of the necktie retainer on the button occurs after the button is passed through a buttonhole of a second portion of the article of clothing.

13. The method of claim 11, wherein the article of clothing comprises a shirt.

14. The method of claim 11, wherein the second piece is magnetically coupled with the first piece at least in part via:

a first magnet coupled with the body of the first piece between a first end of the slot and a first end of the body of the first piece; and a second magnet coupled with the body of the first piece between a second end of the slot and a second end of the body of the first piece.

15. The method of claim 14, wherein the second piece is magnetically coupled with the first piece further via one or more magnets coupled with a first surface of the body of the second piece.

16. The method of claim 11, wherein the slot is elongated along a first dimension relative to a width of the slot in a second dimension, and wherein a height of the body of the first piece in the first dimension, a height of the body of the second piece in the first dimension, or both, is between 2.5 and 3.2 inches.

17. The method of claim 11, wherein the elongated slot is elongated along a first dimension relative to a width of the slot in a second dimension, and wherein a width of the body of the first piece in the second dimension, a width of the body of the second piece in the second dimension, or both, is between 0.25 and 0.8 inches.

18. The method of claim 11, wherein the elongated slot is elongated along a first dimension relative to a width of the slot in a second dimension, and wherein, for a third dimension mutually orthogonal to the first dimension and the second dimension, a thickness of the body of the first piece in the third dimension, a thickness of the body of the second piece in the third dimension, or both, is between 0.03 and 0.15 inches.

19. The method of claim 11, wherein after the second piece is magnetically coupled with the first piece, the button is located between a surface of the body of the first piece and a surface of the body of second piece with which the surface of the body of the first piece is coupled.

20. The method of claim 19, wherein a distance between the surface of the body of the first piece and the surface of the body of second piece is between 0.08 and 0.15 inches.

* * * * *